US006457554B1

(12) United States Patent
Wang

(10) Patent No.: US 6,457,554 B1
(45) Date of Patent: Oct. 1, 2002

(54) ACOUSTIC ABSORBER FOR ABSORBING NOISES IN BUILDINGS

(76) Inventor: Samw Hong Jen Wang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/811,139

(22) Filed: Mar. 15, 2001

(51) Int. Cl.[7] ..... F01N 7/18

(52) U.S. Cl. ..... 181/282; 181/198; 181/224; 181/284; 181/288; 181/286; 181/287

(58) Field of Search ..... 181/282, 198, 181/224, 284, 285, 286, 287

(56) References Cited

U.S. PATENT DOCUMENTS 2,488,048 A * 11/1949 Rinehart ..... 181/224
3,019,850 A * 2/1962 March ..... 181/224
3,846,949 A * 11/1974 Okawa ..... 52/438

FOREIGN PATENT DOCUMENTS

JP 363150412 * 6/1988

* cited by examiner

*Primary Examiner*—Shih-Yung Hsieh

(57) ABSTRACT

An acoustic absorber includes an enclosure having a front opening and having a chamber communicating with the front opening for receiving an acoustic absorbing member which includes a housing having a number of apertures for receiving and dissipating noises. The housing may include a circular cross section or the other cross sections, and may include a casing having a number of apertures for receiving and dissipating the noises. The housing may be detachably secured to the enclosure with one or more catches which may engage with the lock grooves of the enclosure.

6 Claims, 5 Drawing Sheets

ACOUSTIC ABSORBER FOR ABSORBING NOISES IN BUILDINGS

BACKGROUND OF THE INVENTION

1. Field of the Invention

The present invention relates to an acoustic absorber, and more particularly to an acoustic absorber for attaching onto the wall members and for absorbing the noises in the buildings.

2. Description of the Prior Art

Various kinds of typical acoustic absorbers have been developed and used today. FIG. 1 shows one of the typical acoustic absorbers 10 and comprises a front wall 11 and a rear wall 12 and an acoustic absorbing material 13 received between the front wall 11 and the rear wall 12. The front wall 11 includes a number of orifices 14 formed therein for allowing the noise or the like to be transmitted into the acoustic absorbing material 13. The acoustic absorbing material 13 may be made of cotton fibers, composite fibers, or the other composite materials or the like for absorbing the noise. However, the acoustic absorbing material 13 may absorb water or the like such that the acoustic absorbing material 13 may be easily become rotten after use and may thus be easily damaged. The acoustic absorbing effect of the acoustic absorbing material 13 may thus be greatly reduced after use.

The present invention has arisen to mitigate and/or obviate the afore-described disadvantages of the conventional acoustic absorbers.

SUMMARY OF THE INVENTION

The primary objective of the present invention is to provide an acoustic absorber including a structure for effectively absorbing the noises in the buildings.

In accordance with one aspect of the invention, there is provided an acoustic absorber comprising an enclosure including a front portion having an opening formed therein, and including a chamber formed therein and communicating with the front opening thereof, and an acoustic absorbing member including a housing received in the chamber of the enclosure and having a plurality of apertures formed therein for receiving and dissipating noises.

The housing includes a circular cross section and concave inward of the chamber of the enclosure. The housing includes a casing extended therein and having a plurality of apertures formed therein for receiving and dissipating the noises.

An attaching device is further provided for attaching the housing to the enclosure. The housing includes a front portion, the attaching device includes means for securing the front portion of the housing to the enclosure.

The securing means includes at least one board extended from the front portion of the housing and having a catch for securing to the enclosure.

The enclosure includes at least one lock groove formed in the front portion thereof, the at least one board of the housing includes a flange extended therefrom and having the catch provided thereon for engaging into the at least one lock groove of the enclosure and for securing to the enclosure.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
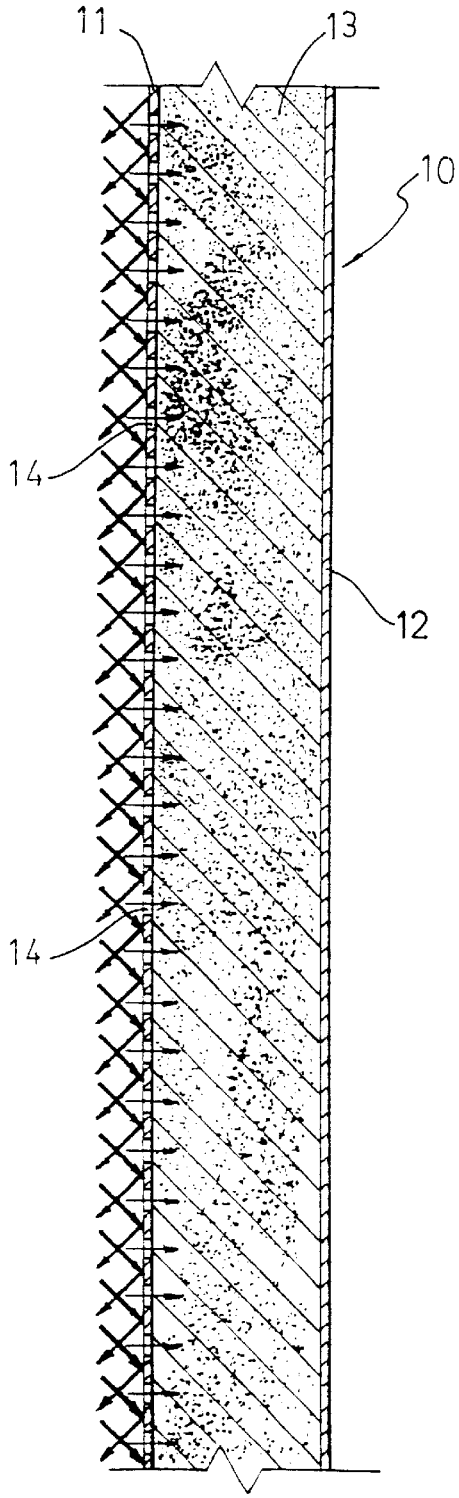
FIG. 1 PRIOR ART
FIG. 1 is a cross sectional view illustrating one of the typical acoustic absorbers.
Figure 2:
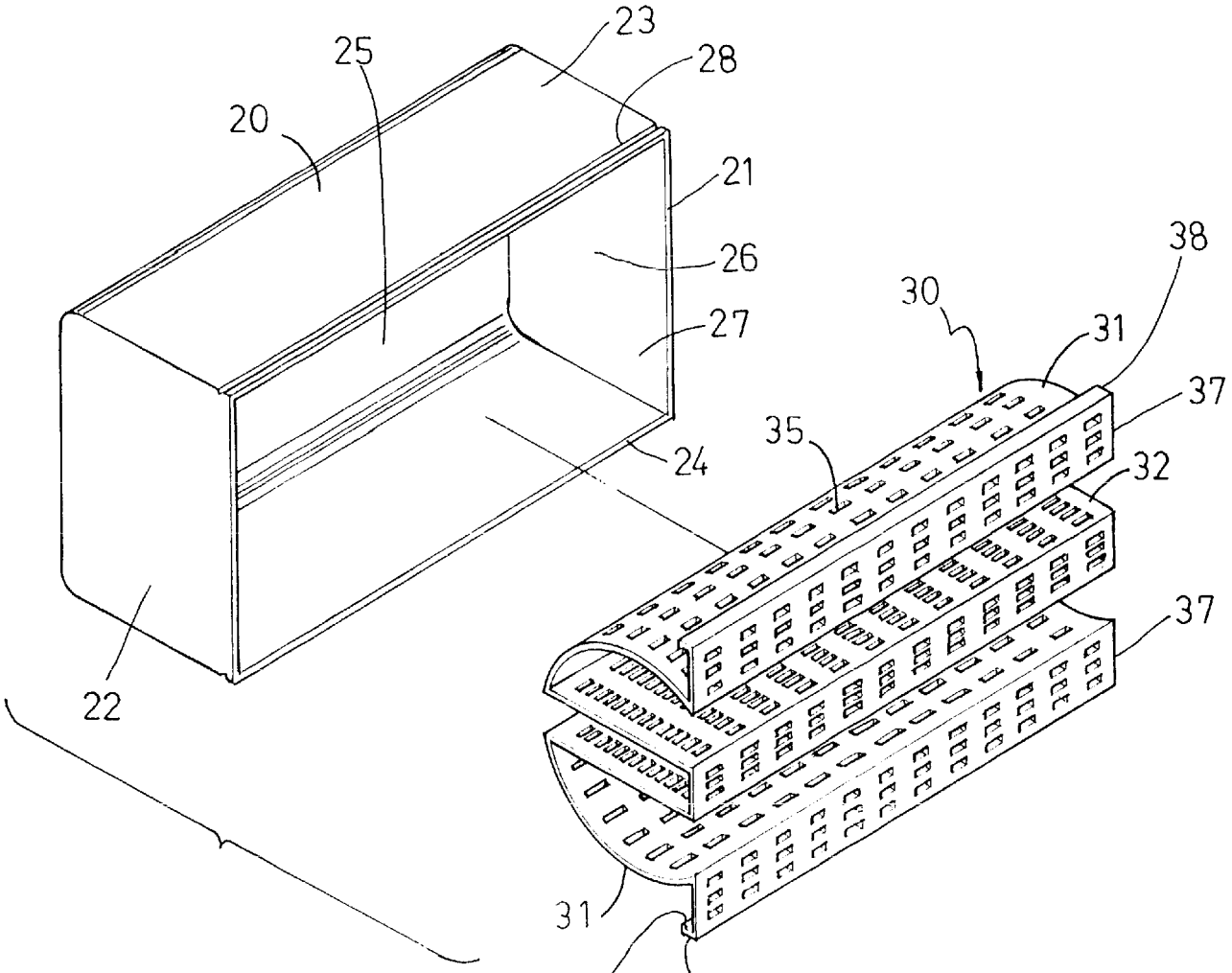
FIG. 2 is an exploded view of an acoustic absorber in accordance with the present invention.
Figure 3:
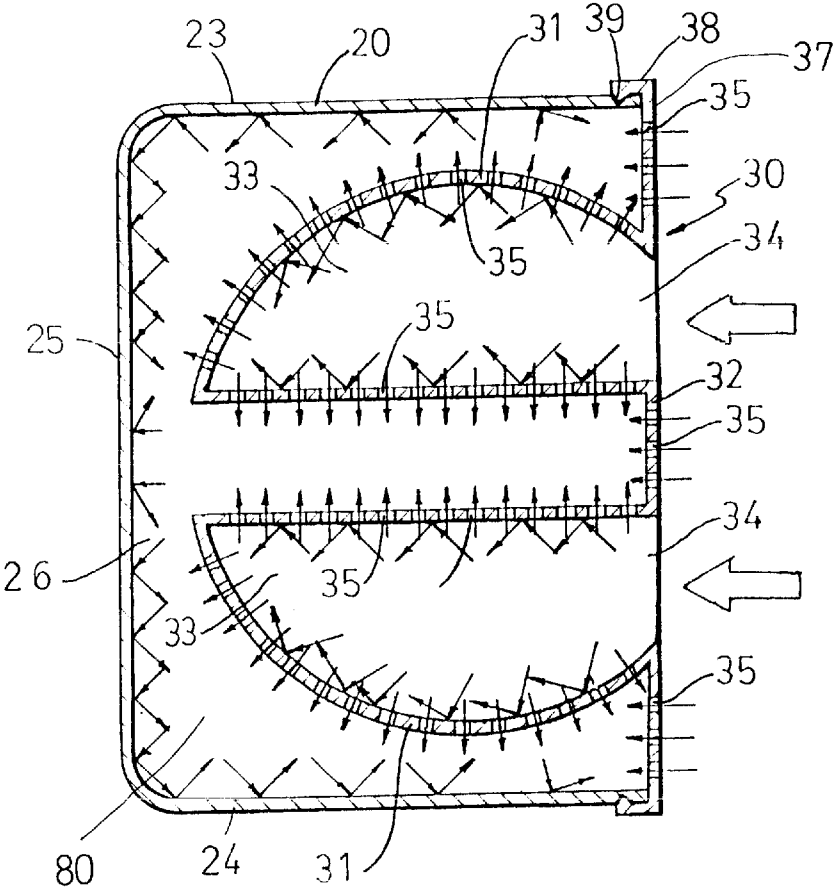
FIG. 3 is a cross sectional view of the acoustic absorber.

Referring to the drawings, and initially to FIGS. 2 and 3, an acoustic absorber in accordance with the present invention may be attached to the wall members of the buildings for absorbing the noises in the buildings and comprises an enclosure 20 including a chamber 26 formed therein and formed or defined by two side panels 21, 22, an upper panel 23, a bottom panel 24 and a rear panel 25, and including an opening 27 formed in the front portion thereof and communicating with the chamber 26 of the enclosure 20 for receiving the noises or the like. The enclosure 20 includes two lock grooves 28 formed in the front portions of the upper panel 23 and the bottom panel 24 respectively.

An acoustic absorbing member 30 is received into the chamber 26 of the enclosure 20 via the front opening 27 of the enclosure 20, and includes a peripheral housing 31 received in the enclosure 20 and spaced from the inner peripheral portion of the enclosure 20 or spaced from the upper panel 23 and the bottom panel 24 and the rear panel 25, such that an acoustic absorbing chamber or space 80 may be formed between the enclosure 20 and the acoustic absorbing member 30. The acoustic absorbing member 30 is concave inward of the enclosure 20 and includes an entrance 34 formed in the front portion thereof for allowing the noises or the like to be transmitted into the peripheral housing 31 of the acoustic absorbing member 30 and to be transmitted into the chamber 26 of the enclosure 20.

Figure 4:
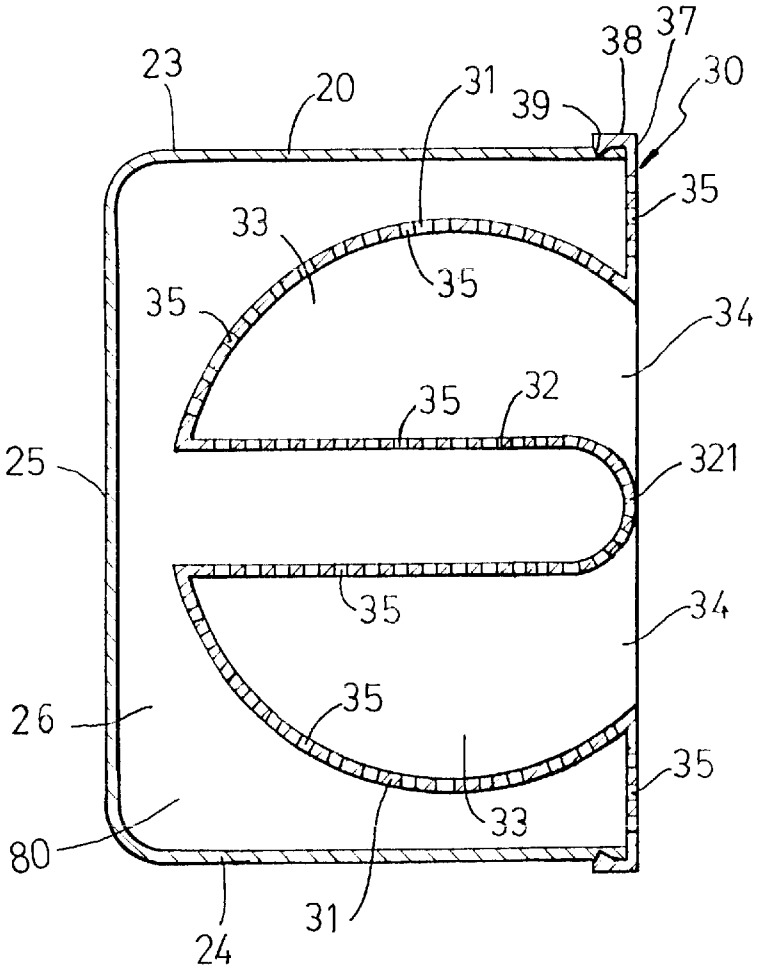
FIGS. 4, 5, 6, 7 are cross sectional views similar to FIG. 3, illustrating the other embodiments of the acoustic absorber.

The acoustic absorbing member 30 may further include a casing 32 extended from the middle portion of the peripheral housing 31 and extended inward of the peripheral housing 31. The casing 32 may be extended toward the front entrance 34 of the housing 31 and may include a flat surface (FIGS. 2, 3) or a curved surface (FIG. 4) formed in the front portion thereof. The peripheral housing 31 and the casing 32 each includes a number of holes or apertures 35 formed therein for allowing the noises or the like to be transmitted into the peripheral housing 31 and the casing 32 of the acoustic absorbing member 30 and to be transmitted into the chamber 26 of the enclosure 20.

The acoustic absorbing member 30 includes an upper board and a lower board 37 extended upward and downward from the front portion of the peripheral housing 31 respectively and each having a flange 38 extended rearward therefrom and each having a hook or a catch 39 extended from the respective flange 38 for engaging into the lock grooves 28 of the enclosure 20 and for detachably securing the acoustic absorbing member 30 to the enclosure 20. It is preferable that the boards 37 and the flanges 38 and the housing 31 and the casing 32 of the acoustic absorbing member 30 are formed as an integral one-piece structure and may be formed by bending from a planer plate or the like.

In operation, as shown in FIG. 3, the noises or the sound waves may be received in the enclosure 20 and the peripheral housing 31, and may be stricken onto the panels 21–25 of the enclosure 20, and may be reflected and/or compressed and/or dissipated within the enclosure 20 and the housing 31 and the casing 32.

Figure 5:
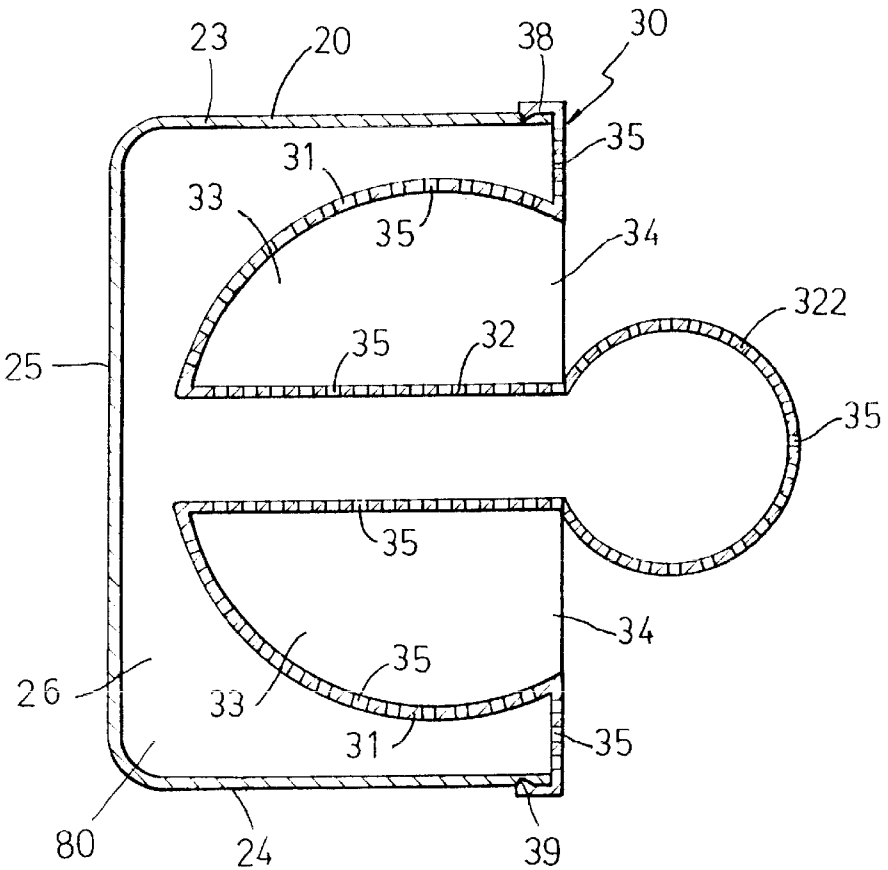
Figure 6:
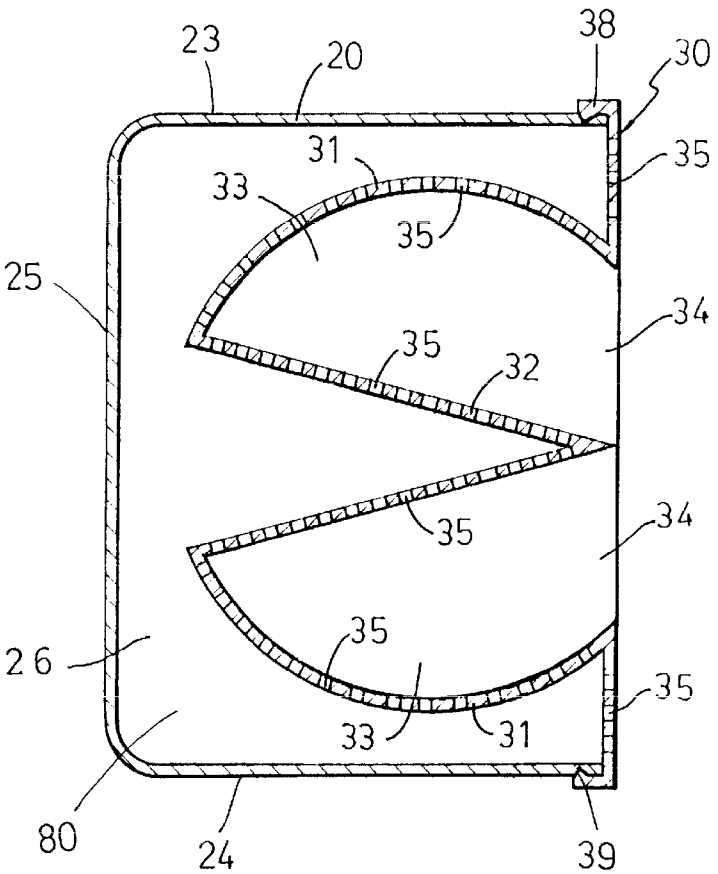
Figure 7:
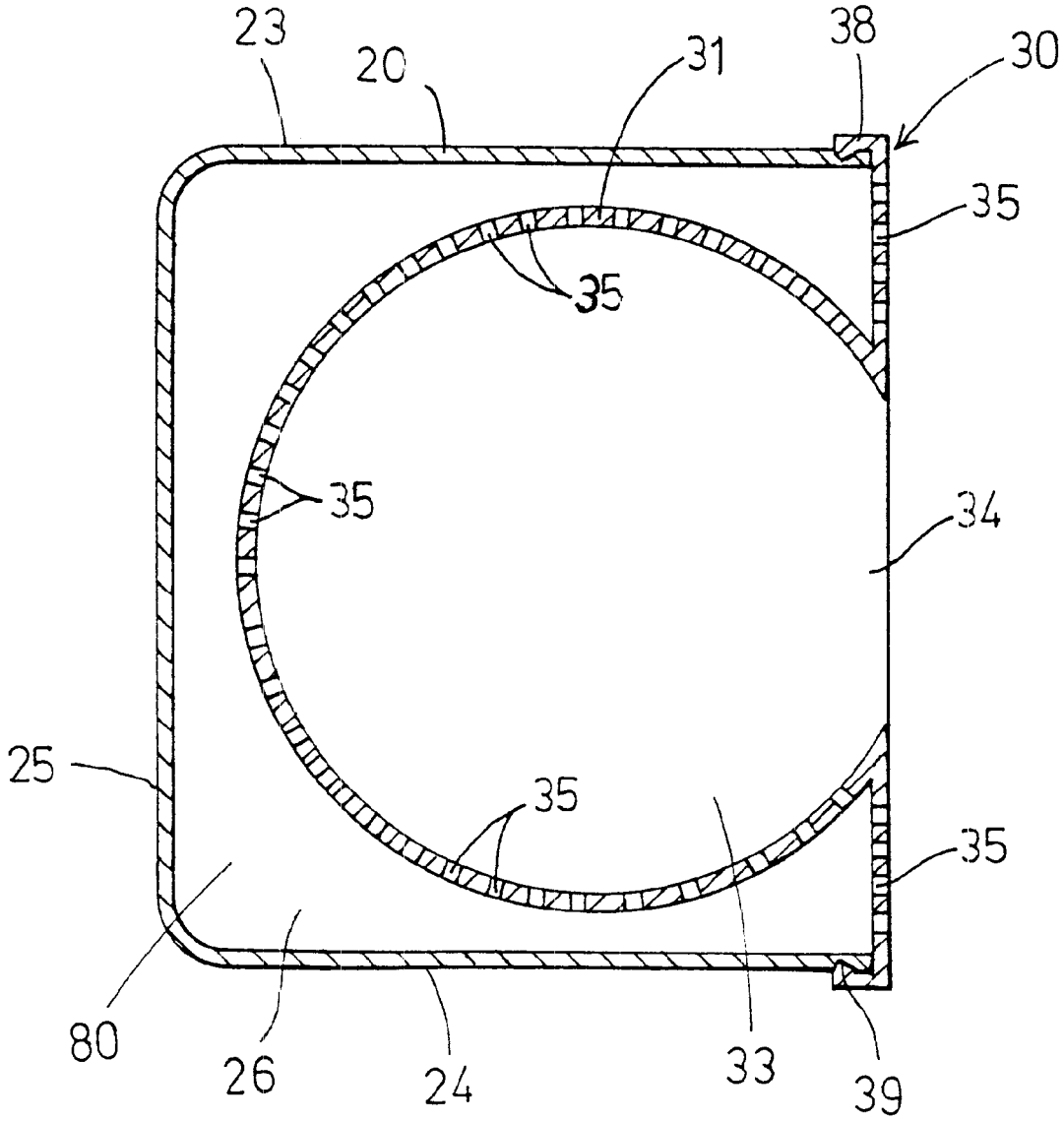

Referring next to FIGS. 4–7, the acoustic absorbing member 30 may simply include the peripheral housing 31 provided therein and received in the chamber 26 of the enclosure 20, having no casing 32 provided therein, as shown in FIG. 7. The casing 32 of the acoustic absorbing member 30 may include a U-shaped cross section having a flat front surface formed thereon (FIG. 3) or having a curved front surface formed thereon (FIG. 4), or may include a V-shaped cross section (FIG. 6), or may include a circular protrusion 322 provided on the front portion of the casing 32 (FIG. 5). The noises may be easily and quickly dissipated and transmitted through the apertures 35 of the peripheral housing 31 and the casing 32 of the acoustic absorbing member 30.

Accordingly, the acoustic absorber in accordance with the present invention includes a structure for effectively-absorbing the noises in the buildings.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An acoustic absorber comprising:

an enclosure including a front portion having an opening formed therein, and including a chamber formed therein and communicating with the front opening thereof, and an acoustic absorbing member including a housing received in said chamber of said enclosure and having a plurality of apertures formed therein for receiving and dissipating noises, said housing including a circular cross section and concave inward of said chamber of said enclosure.

2. The acoustic absorber according to claim 1, wherein said housing includes a casing extended therein and having a plurality of apertures formed therein for receiving and dissipating the noises.

3. The acoustic absorber according to claim 1 further comprising means for attaching said housing to said enclosure.

4. The acoustic absorber according to claim 3, wherein said housing includes a front portion, said attaching means includes means for securing said front portion of said housing to said enclosure.

5. The acoustic absorber according to claim 4, wherein said securing means includes at least one board extended from said front portion of said housing and having a catch for engaging with and for securing to said enclosure.

6. An acoustic absorber comprising:

an enclosure including a front portion having an opening formed therein, and including-a chamber formed therein and communicating-with the front opening thereof, said enclosure including at least one lock groove formed in said- front portion thereof, an acoustic absorbing member including a housing received in said chamber of said enclosure and having a plurality of apertures formed therein for receiving and dissipating noises said housing including a front portion, and means for securing said front portion of said housing to said enclosure, said securing means including at least one board extended from said front portion of said housing and having a catch for engaging with and for securing to said enclosure, said at least one board of said housing including a flange extended therefrom and having said catch provided thereon for engaging into said at least one lock groove of said enclosure and for securing to said enclosure.

* * * * *